US005277553A

United States Patent [19]

Stolpp

[11] Patent Number: 5,277,553

[45] Date of Patent: Jan. 11, 1994

[54] VALVE-CONTROLLED DISPLACER UNIT HAVING VALVE TRIGGERING

[75] Inventor: Dieter Stolpp, Aïchwald, Fed. Rep. of Germany

[73] Assignee: Mercedes-Benz AG, Stuttgart, Fed. Rep. of Germany

[21] Appl. No.: 972,815

[22] Filed: Nov. 6, 1992

[30] Foreign Application Priority Data

Nov. 7, 1991 [DE] Fed. Rep. of Germany ..... 4136624

[51] Int. Cl.[5] ..... F04B 21/00

[52] U.S. Cl. ..... 417/273; 417/298; 417/446; 417/447

[58] Field of Search ..... 417/221, 273, 297, 298, 417/446, 447, 506

[56] References Cited

U.S. PATENT DOCUMENTS

| | | | |
|---|---|---|---|
| 1,678,905 | 7/1928 | Goldberg . | |
| 2,263,786 | 11/1941 | Rumpp | 417/273 |
| 2,539,277 | 1/1951 | Schroepfer | 417/221 |
| 4,432,698 | 2/1984 | Shirakuma | 417/298 |

FOREIGN PATENT DOCUMENTS

| | | | |
|---|---|---|---|
| 432037 | 6/1991 | European Pat. Off. | 417/273 |
| 2425022 | 12/1975 | Fed. Rep. of Germany . | |
| 3740672 | 6/1989 | Fed. Rep. of Germany . | |
| 802046 | 5/1936 | France | 417/221 |
| 1050212 | 1/1954 | France . | |
| 2-64160 | 10/1990 | Japan | 417/273 |
| 3-85380 | 4/1991 | Japan | 417/273 |

*Primary Examiner*—Richard A. Bertsch
*Assistant Examiner*—Roland G. McAndrews, Jr.
*Attorney, Agent, or Firm*—Evenson, McKeown, Edwards & Lenahan

[57] ABSTRACT

The invention relates to a valve-controlled positive displacement pump having valve triggering, which permits the forced opening or keeping open of an inlet valve, operating in the manner of a non-return valve, of a displacer working space, so that the displacer working space remains connected to the inlet side of the unit even during the working stroke of the displacer, and the assigned displacer is not able to work efficiently. The design according to the invention is particularly suitable for radial piston pumps.

17 Claims, 2 Drawing Sheets

VALVE-CONTROLLED DISPLACER UNIT HAVING VALVE TRIGGERING

BACKGROUND AND SUMMARY OF THE INVENTION

The invention relates to a valve-controlled positive displacement pump having valve triggering, which permits the positive opening or keeping open of an inlet valve, operating in the manner of a non-return valve, of a displacer working space, so that the displacer working space can be connected to the inlet side of the unit even during the working stroke of the displacer and can be shut off from the outlet side of the unit by its outlet valve, which remains closed when the inlet valve is open.

German Patent Document DOS 3,028,396 discloses an appropriate piston pump having piston working spaces arranged in series. Special fluid members can be used forcibly to lift the suction valves out of their closed position or to prevent them from reaching the closed position. As a result, the respective pistons are prevented from doing effective pumping, because it is not possible to build up an effective pressure in the piston working spaces.

The delivery rate of the pump can be matched very quickly to the respective requirements by means of the suction valve triggering, without the need to shut down the pump or its drive.

Again, there are in principle other possibilities for quickly shutting down the delivery flow of a piston pump.

For example, a pump can work, if necessary, in so-called circulating operation, in which it is achieved by appropriate control of a reversing valve that the medium delivered by the pump flows back by a short path to the suction side or to a reservoir arranged on the suction side, and is not fed to the respective load on the pressure side of the pump. A corresponding arrangement is represented with reference to a radial piston pump in German Patent Document DOS 2,425,022. In this case, the reversing valve is controlled as a function of the pressure applied to the load, it being the case that upon the reaching of a first pressure threshold value initially only a restriction of the flow on the suction side of the pump is formed, in order in this way to reduce the delivery rate of the pump. As soon as a second pressure threshold value is then reached on the pressure side of the pump, a switch is made to circulating operation, so that the pump no longer works effectively.

It is known from British Patent Document 1,413,998 to provide two piston working spaces whose pistons work in anti-phase with a connecting line which can be shut off. The pump works in the normal way in the closed state of this connecting line. As soon as the connecting line is opened and a flow is enabled in both directions, the pumping medium is shifted back and forth continuously between the two piston working spaces, because the pressure stroke of the piston in one piston working space coincides with the suction stroke of the piston in the other piston working space. Consequently, the pumping medium displaced from the one piston working space is received by the other piston working space. In this way, the pump is prevented from working effectively.

If necessary, it can be provided in accordance with British Patent Document 1,413,998 to arrange a non-return valve in the connecting line, so that after opening of the connecting line only a flow in one direction is enabled. The consequence of this is that during the pressure stroke of the piston in one piston working space the pumping medium can be shifted from this piston working space into the other piston working space, whose piston is executing a suction stroke. As soon thereafter as the direction of movement of the piston is reversed, the medium displaced by the other piston, which is now in the pressure stroke, cannot flow back through the connecting line—it is, rather, expelled to the pressure side of the pump by the pressure valve assigned to the other piston. In this way, the working of only one piston is rendered virtually ineffective, that is to say the delivery rate of the pump is halved.

A stepped control of the pump can also be undertaken in this way. The first step is, for the purpose of reducing the pumping capacity, to release only one connecting line having a non-return valve in order to reduce the delivery rate of the pump. Thereafter, a connecting line which allows flow in both directions can then be released in order to switch the pump to become ineffective.

U.S. Pat. No. 3,682,565 shows a radial piston pump whose pistons are loaded by means of springs against an eccentric which drives the pistons and whose circumference interacts with the facing end faces of the pistons. The piston working spaces each have a pressure valve which is arranged on the pump housing coaxially with the respective piston and whose valve body controls a bore coaxial with the piston. The suction valves are arranged in each case on the piston side, the suction valve body in the associated piston controlling an axial bore which communicates via radial bores in the piston with the eccentric working space, which forms the suction side of the pump or is connected thereto. Arranged on the pressure side of the pressure valves are relief valves which in normal operation connect the outlet side of the pressure valves to the pressure side of the pump or to the load connected there. As soon as a pressure threshold value is reached, the respective relief valve reverses, the outlet side of the pressure valve of the respectively assigned piston working space being connected to the suction side and simultaneously shut off from the pressure side of the pump or from the load connected there.

It is achieved in this way that individual pistons or all the pistons of the pump are unable to deliver any pumping medium to the pressure side or to the load a soon as the pressure threshold value is reached.

German Patent Document DOS 3,740,672 discloses a valve-controlled piston pump in which the piston working spaces are assigned in each case a separate outlet valve upon the opening of which the piston working space is connected to the suction side of the pump. Consequently, a similar effect is achieved as in the case of suction valve triggering.

For the rest, reference is made to the technological background to be seen in German Patent Documents DOS 3,240,405; DOS 3,504,163; and DOS 1,653,632.

It is an object of the invention to provide a positive displacement pump equipped with valve triggering, whose design is also well suited for realizing a radial piston pump having triggering of the inlet valve, that is to say having suction valve triggering.

This object is achieved according to preferred embodiments of the invention by providing an arrangement comprising a:

valve-controlled positive displacement fluid device arrangement having valve triggering, which permits the forced opening or keeping open of an inlet valve, operating in the manner of a non-return valve, of a displacer working space, so that the displacer working space can be connected to the inlet side of the unit even during the working stroke of the displacer and can be shut off from the outlet side of the unit by its outlet valve, which remains closed when the inlet valve is open, wherein the displacer includes a piston which is spring-loaded against an eccentric which drives it, wherein the associated inlet valve is arranged on the piston and controls by means of its valve body an inlet opening penetrating the piston from a space on the inlet side to the piston working space, wherein the eccentric or a sleeve-like part arranged on its circumference is axially displaceable, and wherein arranged on the circumference of the eccentric or of the sleeve-like part are axially adjacent regions whose otherwise identical cross-sections have different diameters, it being the case that in one axial position of the circumference the region having the larger diameter keeps the inlet valve body away from its closed position in the manner of a stop, whereas the other region having the smaller diameter becomes effective in another axial position of the circumference and permits closure of the inlet valve body.

The invention is based on the general idea of controlling the mobility of the inlet valve body by elements on the eccentric side which, for their part, can be switched to become effective or ineffective by axial displacement in the direction of the axis of rotation of the eccentric.

It is advantageous in this case that the invention can be directly realized with radial piston pumps, because essential parts of conventional radial piston pumps can be taken over virtually unchanged. Consequently, the invention is explained below principally with reference to pumps.

Nevertheless, the invention is not restricted to pumps. Rather, preferred embodiments of the invention can also advantageously be used with hydraulic motors and serve there to vary the motor displacement.

In order to apply the invention in the above-mentioned radial piston pumps, it is essentially sufficient to construct the suction valve such that the suction valve body can interact with the above-mentioned regions on the circumference of the eccentric or of the sleeve-shaped part.

According to a preferred embodiment, it can be provided for this purpose that there is arranged on the suction valve body an extension or stem which is directed against the eccentric and which interacts with the regions of different cross-section on the circumference of the eccentric or of the sleeve-shaped part in such a way that the suction valve is able to close when the region of smaller cross-section is pushed into the zone of movement of the extension or stem, while the extension or stem bears against the region of larger cross-section before the closing position of the suction valve body is reached when the eccentric or the sleeve-shaped part is correspondingly axially displaced.

In a particularly preferred embodiment, it is possible to arrange on the circumference of the axially displaceable eccentric or of the axially displaceable sleeve-shaped part a circumferential groove, which can be relatively displaced by displacing the eccentric or the sleeve-shaped part into the region of movement of the extension or stem, and thus enable closure of the suction valve body.

In this embodiment, the circumferential regions of the eccentric or of the sleeve-shaped part, which axially adjoin the circumferential groove, can serve in all axial positions of the eccentric or of the sleeve-shaped part to guide and to drive the pump piston or the pump pistons and moreover, given appropriate displacement of the eccentric or of the sleeve-shaped part, take over the function of a stop, interacting with the extension or stem of the suction valve body, in order to prevent the suction valve body from assuming its closing position.

The above-noted circumferential groove is likewise able to take over a double function by, on the one hand, permitting closure of the suction valve body in the corresponding axial position of the eccentric or of the sleeve-shaped part and, on the other hand, producing between the eccentric or sleeve-shaped part and the eccentric-side end face of the piston in this operating state, a channel suitable for the passage of pumping medium which communicates with a suction opening in the piston or piston cap that is controlled by the suction valve body.

Embodiments are contemplated with construction of the piston-side opening controlled by the suction valve body as an axial bore of the piston and connecting it to the eccentric working space, which is constructed as the suction side of the pump or is connected to a suction port of the pump, without appreciable restriction.

The same basically applies when instead of the circumferential groove a circumferential stage or protrusion is arranged on the circumference of the eccentric or of the sleeve-shaped part, so that a region of the eccentric or of the sleeve-shaped part of small cross-section is formed on the one side of the circumferential stage, and a region of larger cross-section is formed on the other side.

One side wall or both side walls of the circumferential groove can also be constructed as a cone. Again, a conical region can be provided instead of a circumferential stage having a steep transition between the regions of different cross-section. It is possible in this way in the case of axial displacement of the eccentric or of the sleeve-shaped part to open a previously closed suction valve relatively slowly by virtue of the fact that the extension or stem of the suction valve body slides onto the conical region during axial displacement of the eccentric or of the sleeve-shaped part.

Other objects, advantages and novel features of the present invention will become apparent from the following detailed description of the invention when considered in conjunction with the accompanying drawings.

DETAILED DESCRIPTION OF THE DRAWINGS

Figure 1:
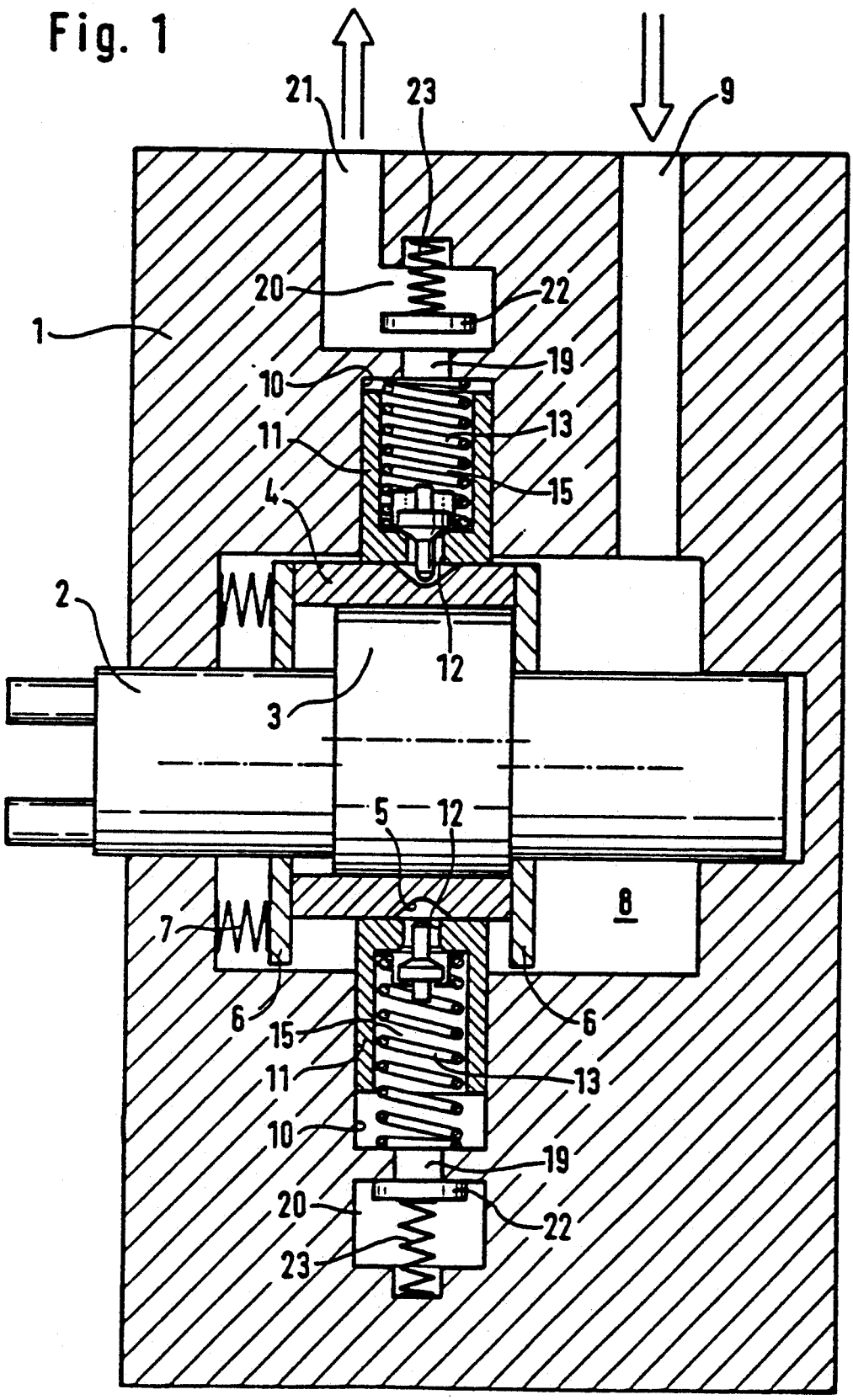
FIG. 1 shows an axial section of a radial piston pump having suction valve triggering, constructed according to a preferred embodiment of the invention.

In the radial piston pump represented in the drawing, a drive shaft 2 on which an eccentric 3 is arranged in a rotationally fixed fashion is rotatably mounted inside an axial bore in a pump housing 1.

A cylindrical sleeve 4 is arranged on the eccentric 3 rotatably and axially displaceably, but virtually immovably in the radial direction relative to the eccentric 3. The external circumference of the sleeve 4 is provided with a circumferential groove 5 whose side walls merge conically into the cylindrical external circumference of the sleeve 4.

Slides 6, which are radially mounted on the drive shaft 2 and of which the left-hand slide in FIG. 1 is loaded by means of a spring 7 to the right against the facing end face of the sleeve 4, are displaceably arranged on both end faces of the sleeve 4. The right-hand slide in FIG. 1 can be displaced by means of switching members (not represented) from the normal position represented in FIG. 1, in which this right-hand slide 6 bears against the facing end face of the eccentric 3, to the right, or be restored from its position displaced to the right into the position represented. In this case, the sleeve 4 follows the movements of the right-hand slide 6 in FIG. 1, because the spring 7 continuously attempts by means of the left-hand slide 6 in FIG. 1 to press the sleeve 4 against the right-hand slide 6 in FIG. 1.

The outside diameter of the slides 6 is somewhat smaller than the inside diameter of the working space 8 in the pump housing 1 for the eccentric, so that all the regions of the eccentric working space can communicate with a housing bore 9 which forms the suction port of the pump.

Cylindrical bores 10 which open into the eccentric working space 8 in the pump housing 1 and in which pistons 11 are displaceably guided are arranged radially to the axis of the drive shaft 2. The pistons 11 have an essentially beaker-like shape (or cup-like), the piston caps being arranged on the eccentric-side end faces of the pistons 11 and provided with centric axial suction bores 12. By means of piston return springs 13, which are clamped under pressure between the piston caps, on the one hand, and constrictions, in the shape of circumferential stages or supports, of the cylindrical bores 10, on the other hand, the pistons 11 are pressed against the external circumference of the sleeve 4 mounted on the eccentric 3, that is to say the piston caps are permanently situated on the external circumference of the sleeve 4.

Figure 2:
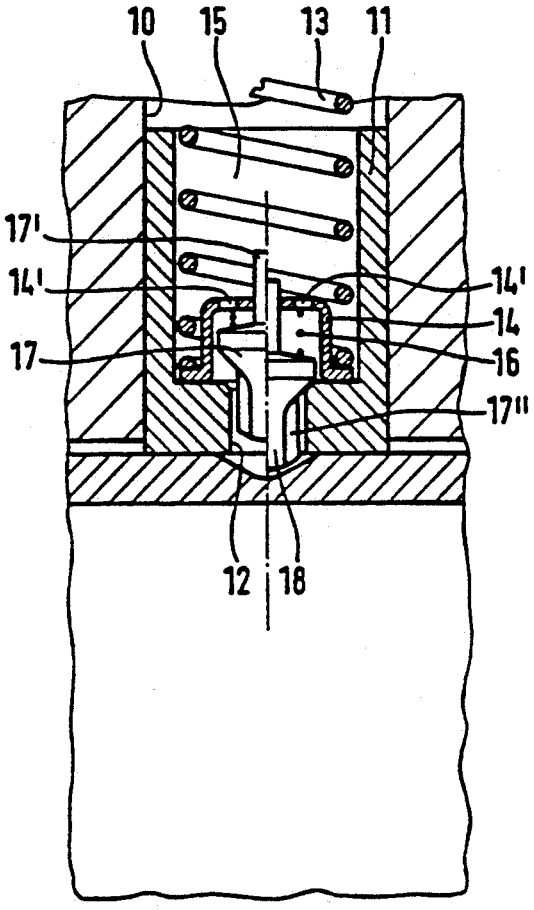
FIG. 2 shows an enlarged representation of the suction valve of FIG. 1 in normal operation, the closed position being represented on one side and the open position on the other side of the drawing.
Figure 3:
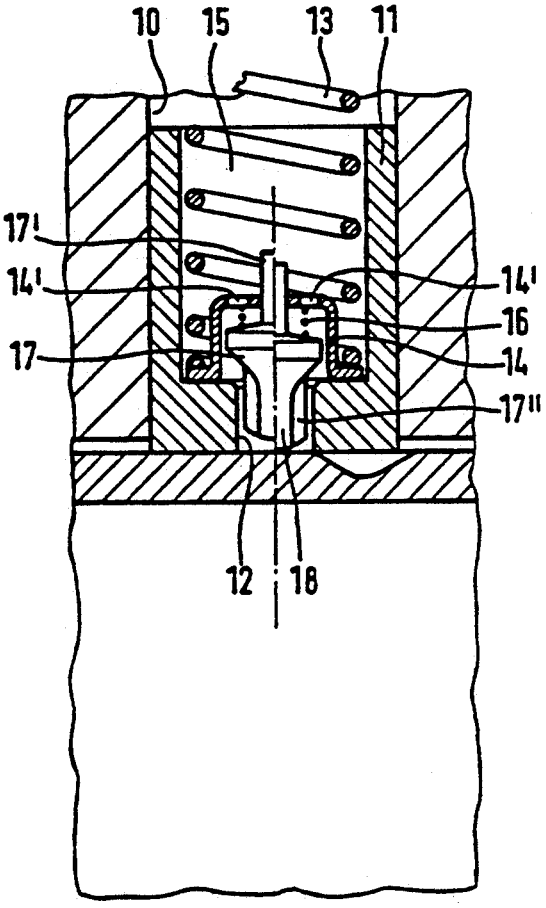
FIG. 3 shows a representation, corresponding to FIG. 2, of a suction valve in the triggered state.

It is provided in accordance with FIGS. 2 and 3 that the piston return springs I3 serve to retain spring cages 14 by arranging that the piston return springs 13 bear against flange-like rims of the spring cages 14 and press these flange-like rims against the piston cap.

The spring cages 14 have one or more openings 14', so that the suction bores 12 in the caps of the pistons 11 are able to communicate with the piston working spaces 15 in the cylindrical bores 10.

The spring cages 14 serve as abutments for suction valve springs 16 which, for their part, attempt to press the suction valve bodies 17, which control suction bores 12, in their closed position against assigned seats which are constructed on the inside of the piston caps on the end faces of the suction bores 12 there.

The suction valve bodies 17 can interact by means of conical sealing surfaces with the above-mentioned seats.

The purpose of guiding the suction valve bodies 17 is served by extensions 17' which are arranged thereon and guided axially displaceably in a guide bore of the respective spring cage 14, as well as by guide webs 17'', which are arranged in the form of a star and are arranged radially on a stem 18 of the respective suction valve body 17 which penetrates the respective suction bore 12.

The stems 18 are dimensioned such that they permit a complete closing movement of the respective suction valve body 17 with the piston 11 bearing against the circumference of the sleeve 4 only if the sleeve-side end of the respective stem 18 is able by virtue of corresponding axial setting of the sleeve 4 to enter the circumferential groove 5 thereof.

Seen from the axis of the drive shaft 2, the cylindrical bores 10 extend radially outwards into pressure bores 19, which are coaxial with the cylindrical bores 10 and open into a collecting channel 20, which is arranged in the pump housing 1, has a ring shape relative to the axis of the drive shaft 2, and communicates, for its part, with a housing bore 21 which forms the pressure port of the pump.

The pressure bores 19 are controlled by, for example, plate-shaped pressure valve bodies 22, which are pressed by means of pressure valve springs 23 against valve seats shaped like annular plates on the ends of the pressure bores 19 opening into the collecting channel 20.

The radial piston pump represented works as follows:

In normal pump operation, the sleeve 4 is set to its axial normal position represented in FIGS. 1 and 2, in which the circumferential groove 5 is situated with its cross-section approximately central relative to the suction bores 12 in the piston 11. Consequently, the stems 18 of the suction valve bodies 17 are able to enter the circumferential groove 5, and the suction valve springs 16 can push the associated suction valve bodies 17 into their completely closed position.

As the drive shaft 2 rotates, the piston 11 is forced into reciprocating movements by the eccentric 3 via the sleeve 4 mounted thereon, pressure strokes being directed radially outwards from the axis of the drive shaft 2 and suction strokes being directed radially inwards with regard to this axis. Since in the aforementioned normal position of the sleeve 4 the suction valve bodies 17 are able to assume their closed position, the reciprocating work of the pistons performs effective pumping work. Thus, during the suction stroke of a piston 11 the pressure valve body 22 shuts off the respective piston working space 15 from the collecting space 20, while the suction valve body 17 is raised from its seat, so that pumping medium can flow from the housing bore 9 forming the suction port of the pump via the eccentric working space 8 into the respective piston working space 15. Only slight restriction losses occur in this process, because, despite the caps of the pistons 11 bearing against the external circumference of the sleeve 4, the circumferential groove 5 of the sleeve 4 situated in the region of the suction bores 12 ensures a low-restriction connection between the eccentric working space 8 and the suction bores 12.

During the subsequent pressure stroke of a piston 11, the suction valve body 17 closes the respective suction bore 12, while the pressure valve body 22 is raised from its seat and the pumping medium that has previously flowed into the piston working space 15 is expelled in the course of the pressure stroke of the piston 11 into the collecting channel 20 and thus towards the housing bore 21 forming the pressure port.

As soon as the sleeve 4 is displaced to the right from the normal position represented in FIGS. 1 and 2 into a triggering position shown in FIG. 3, the circumferential groove 5 of the sleeve 4 is situated outside the region of the suction bores 12 of the pistons 11. Consequently, the stems 18 of the suction valve bodies 17 are no longer able to enter the circumferential groove 5. As a consequence, the suction valve bodies 17 are prevented from reaching their completely closed position, or in the case of the aforementioned adjustment of the sleeve 4 are raised from their completely closed position, cf. FIG. 3.

Consequently, irrespective of which position the suction valve body 17 assumes in the range of its residual mobility to be seen from FIG. 3, the respective suction bore 12 of the piston 11 remains permanently open, and the respective piston working space 15 remains permanently connected to the eccentric working space 8.

Consequently, the respective piston is unable to perform effective pumping work during its reciprocating movements, because by virtue of the suction valve body 17 remaining in the open position it is also impossible during the pressure stroke of the piston 11 for there to build up in the piston working space 15 an adequate pressure which would be required in order to lift the pressure valve body 22 out of its closed position. As a result, during the pressure stroke of the piston 11 pumping medium that has previously flowed into the piston working space 15 is expelled through the suction bore 12, which remains open, into the eccentric working space 8.

Upon displacement of the sleeve 4 from the normal position into the triggering position, a suction valve body 17 which may previously have been in its closed position is forcibly raised from its closed position. By virtue of the conical flanks of the circumferential groove 5, this lifting movement is performed with a desirable softness, so that the suction valve body 17 moved in the opening direction firstly releases only a severely restricted connection from the piston working space 15 to the suction bore 12.

In a departure from the represented embodiment, in which the cylindrical bores 10 are arranged in a single radial plane relative to the axis of the drive shaft 2, the pump housing can also have cylindrical bores 10 arranged in a plurality of planes. If each plane is assigned a separate sleeve 4 having a circumferential groove 5, the possibility exists of switching on the suction valve triggering only in individual planes or jointly in all planes, so that the delivery rate of the pump can be changed in a plurality of stages.

In certain preferred embodiments, it is also possible in the case of cylindrical bores 10 arranged in a plurality of planes for a single sleeve 4 to be arranged with a widened circumferential groove 5 in such a way that in the normal position of the sleeve 4 the stems 18 of all the suction valve bodies 17 can enter the circumferential groove 5 and thus enable complete closure of the suction valve bodies 17. Now, if the sleeve 4 is axially displaced, the suction valve bodies 17 of the different planes of the cylindrical bores 10 are successively raised out of the completely closed position or prevented from assuming the completely closed position.

For the rest, in the case of cylindrical bores 10 arranged in a plurality of planes it is also contemplated in certain preferred embodiments for a single sleeve 4 to be arranged with a plurality of circumferential grooves 5, each circumferential groove 5 being assigned to a plane of the cylindrical bores. If the plurality of circumferential grooves 5 have the same width, the stems 18 of all the suction valve bodies 17 are switched over simultaneously in all planes between the normal mode of operation and the triggered state. In the event of different widths of the circumferential grooves 5 it can be achieved that valve triggering is performed in a different number of planes depending on the extent of the displacement of the sleeve 4.

Embodiments are also further contemplated with both pistons 11 having triggerable suction valve bodies 17 and pistons 11 having non-triggerable suction valve bodies, arranged in one or more planes, for example, ones without stems 18 or having stems 18 so short that the latter are unable to reach the sleeve 4. It is not possible in this way to bring the output of the pump to zero—rather, only a reduction in the output occurs in the case of triggering of the triggerable valve body 17, the extent of the reduction being stipulated by the numerical ratio between triggerable and non-triggerable valves.

In the event of the arrangement of the cylindrical bores 10 in a plurality of planes, the numerical ratio between triggerable and non-triggerable valves can be variously dimensioned.

Finally, in a departure from the embodiment represented in FIG. 1 it is contemplated by means of switching members that are not represented for the two slides 6 to be provided with a positive control in such a way that the two slides 6 can be adjusted simultaneously or approximately simultaneously to the right or left. The spring 7 represented in FIG. 1 can therefore be eliminated.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. Valve-controlled positive displacement fluid device arrangement having valve triggering, which permits the forced opening or keeping open of an inlet valve, operating in the manner of a non-return valve, of a displacer working space, so that the displacer working space can be connected to the inlet side of the unit even during the working stroke of the displacer and can be shut off from the outlet side of the unit by its outlet valve, which remains closed when the inlet valve is open, wherein the displacer includes a piston which is spring-loaded against an eccentric which drives it, wherein an associated inlet valve is arranged on the piston and controls by means of its valve body an inlet opening penetrating the piston from a space on an inlet side to a piston working space, wherein the eccentric is axially displaceable, and wherein arranged on the circumference of the eccentric are axially adjacent regions whose otherwise identical cross-sections have different diameters, it being the case that in one axial position of the circumference the region having the larger diameter keeps the inlet valve body away from its closed position in the manner of a stop, whereas the other region having the smaller diameter becomes effective in another axial position of the circumference and permits closure of the inlet valve body.

2. Positive displacement fluid device arrangement according to claim 1, wherein the eccentric includes an eccentric member surrounded by a sleeve-like part.

3. Positive displacement fluid device arrangement according to claim 1, wherein a plurality of inlet valves and working spaces are provided.

4. Positive displacement fluid device according to claim 1, wherein the fluid device is a pump with a driven shaft.

5. Positive displacement pump according to claim 4, wherein a circumferential groove is arranged on the circumference of the eccentric in order to form said region of smaller diameter.

6. Positive displacement pump according to claim 2, wherein the sleeve-shaped part can be adjusted relative to the eccentric member in the axial direction of the drive shaft by means of a slide which is axially displaceable on a drive shaft of the eccentric member.

7. Positive displacement pump according to claim 4, wherein an eccentric working space is connected to the inlet port of the device and communicates via the inlet valve with the piston working space.

8. Positive displacement pump according to claim 4, wherein said axial adjacent regions of different diameters interact with an extension or stem which is arranged on the inlet valve body and is directed against the eccentric and prevents the inlet valve body from reaching the closing position.

9. Positive displacement pump according to claim 8, wherein a circumferential groove is arranged on the circumference of the eccentric in order to form said region of smaller diameters.

10. Positive displacement pump according to claim 4, wherein the inlet valve body controls an inlet opening axially penetrating a piston cap of the piston.

11. Positive displacement pump according to claim 10, wherein the inlet valve body is acted upon in a closing fashion by means of a valve spring which is constructed as a helical compression spring with an end averted from the inlet valve body supported on a spring cage which is loaded by means of a further spring pressing the piston against the eccentric.

12. Positive displacement pump according to claim 4, comprising housing-side parts and wherein the outlet valve is arranged on the housing-side parts.

13. Positive displacement fluid device arrangement according to claim 12, wherein a plurality of outlet valves are provided.

14. Valve controlled fluid device comprising:

a housing;

a rotatable shaft mounted to be rotatable in the housing;

a least one eccentric member mounted on the shaft in a working space of the housing;

a fluid suction port opening into the housing space, at least one piston disposed for reciprocal movement in response to rotational movement of the eccentric member, said at least one piston being elastically loaded against the eccentric member;

a fluid inlet valve arranged on the piston and including an inlet valve body which controls an inlet opening penetrating the piston from a space on an inlet side to a piston working space;

a circumferential surface portion surrounding the eccentric and serving to drivingly engage the piston to cause reciprocating movement of the piston;

said circumferential surface portion including axially adjacent regions with different diameters with respect to the rotational axis of the shaft but with otherwise similar cross-sectional shapes;

apparatus for selectively axially shifting the circumferential surface portion between a normal operating position permitting sequential closure of the fluid inlet valve during rotation of the shaft; and a triggering position which prevents closure of the fluid inlet valve during rotation of the shaft.

15. Valve controlled fluid device according to claim 14, wherein the fluid device is a pump with a driven shaft.

16. Valve controlled fluid device according to claim 14, wherein the circumferential surface portion is located on an axially shiftable sleeve member which surrounds the eccentric.

17. Valve controlled fluid device according to claim 16, wherein the different diameters are formed by a circumferential groove surroundign the sleeve member.

* * * * *